US005452481A

United States Patent [19]

Meyer

[11] Patent Number: 5,452,481

[45] Date of Patent: Sep. 26, 1995

[54] PORTABLE VENTILATION SYSTEM

[75] Inventor: John R. Meyer, Denison, Iowa

[73] Assignee: Bejon Technology, Inc., Storm Lake, Iowa

[21] Appl. No.: 234,928

[22] Filed: Apr. 28, 1994

[51] Int. Cl.[6] ..... E03D 9/052

[52] U.S. Cl. ..... 4/213; 55/320

[58] Field of Search ..... 4/213; 55/320, 55/473

[56] References Cited

U.S. PATENT DOCUMENTS

| | | | |
|---|---|---|---|
| 1,134,294 | 4/1915 | Supanz | 55/473 X |
| 1,862,085 | 6/1932 | Hertzog | 4/213 |
| 2,017,590 | 10/1935 | Duffner | 4/213 |
| 2,093,082 | 9/1937 | Karlstrom | 55/473 X |
| 2,849,727 | 9/1958 | Bollinger et al. | 4/217 |
| 3,659,296 | 5/1972 | Stamper | 4/217 |
| 3,790,970 | 2/1974 | Bendersky et al. | 4/217 |
| 3,849,808 | 11/1974 | Olson et al. | 4/213 |
| 3,857,119 | 12/1974 | Hunnicutt, Jr. | 4/213 |
| 3,913,150 | 10/1975 | Polster et al. | 4/213 |
| 4,094,023 | 6/1978 | Smith | 4/213 |
| 4,620,329 | 11/1986 | Wix | 4/217 |
| 4,726,078 | 2/1988 | Carballo et al. | 4/347 X |
| 4,876,748 | 10/1989 | Chun | 4/213 |
| 4,893,359 | 1/1990 | Vu et al. | 4/216 |
| 4,933,996 | 6/1990 | Sowards | 4/213 |
| 4,944,045 | 7/1990 | Agelatos et al. | 4/213 |

FOREIGN PATENT DOCUMENTS

| | | | |
|---|---|---|---|
| 0331192 | 9/1989 | European Pat. Off. | 4/213 |

*Primary Examiner*—Robert M. Fetsuga

*Attorney, Agent, or Firm*—Zarley, McKee, Thomte, Voorhees & Sease; Mark D. Frederiksen

[57] ABSTRACT

A portable ventilation system includes an air filter unit located remotely from a toilet and having an air duct extending from the filter unit to the toilet to exhaust and deodorize air from the toilet bowl. The filter unit includes an impeller which moves air through charcoal type filter media and exits the filter unit through a plurality of apertures in the bottom of the unit. An air duct is slidably journaled between the toilet seat and toilet bowl rim upper surface at the rearward end of the seat, and is connected to the filter unit to draw air from the toilet bowl and through the filter unit. A control unit is electrically connected to the filter unit and includes a switch to activate the impeller in the filter unit to operate the ventilation system. In one embodiment of the invention, a sensor is mounted in the control unit so as to sense the presence of a person on the toilet to automatically activate the filtration system.

6 Claims, 3 Drawing Sheets

PORTABLE VENTILATION SYSTEM

TECHNICAL FIELD

The present invention relates generally to ventilation apparatus for toilet bowls, and more specifically to a toilet ventilation system which is portable and easily installed.

BACKGROUND OF THE INVENTION

The prior art is replete with systems designed to exhaust odorous gases from a toilet. The problem of eliminating such gases has been recognized, in view of the numerous patents drawn to this problem, but has not but fully solved.

The prior art solutions to this problem typically involve the installation of additional water flushing mechanisms, or separate venting assemblies that convey odors to atmospheric venting pipes. Such structural modification to existing toilets are expensive, and typically require skilled labor.

Other types of venting systems utilize seats with ventilation apparatus connected thereto. While in most cases the ventilated toilet seat structures are simpler and less expensive than other alternatives in the prior art, such apparatus still require the replacement of the existing toilet seat on a toilet. With the wide variety of customized and stylized seats now on the market, the use of a ventilated toilet seat would prevent the use of many of the features which consumers now look for in the marketplace.

SUMMARY OF THE INVENTION

It is therefore a general object of the present invention to provide an improved ventilation system for toilets which does not replace any existing components of the toilet.

Another object is to provide a ventilation system for toilets which is portable between more than one location.

Such another object of the present invention is to provide a portable ventilation system which may be operated by a self-contained battery.

A further object is to provide a portable ventilation system which is simple to install and operate, economic to manufacture, and refined in appearance.

These and other objects of the present invention will be apparent to those skilled in the art.

The portable ventilation system of the present invention includes an air filter unit located remotely from a toilet and having an air duct extending from the filter unit to the toilet to exhaust and deodorize air from the toilet bowl. The filter unit includes an impeller which moves air through activated carbon type filter media and exits the filter unit through a plurality of apertures in the bottom of the unit. An air duct is slidably journaled between the toilet seat and toilet bowl rim upper surface at the rearward end of the seat, and is connected to the filter unit to draw air from the toilet bowl and through the filter unit. A control unit is electrically connected to the filter unit and includes a switch to activate the impeller in the filter unit to operate the ventilation system. In one embodiment of the invention, a sensor is mounted in the control unit so as to sense the presence of a person on the toilet to automatically activate the filtration system.

DESCRIPTION OF THE PREFERRED EMBODIMENT

Figure 1:
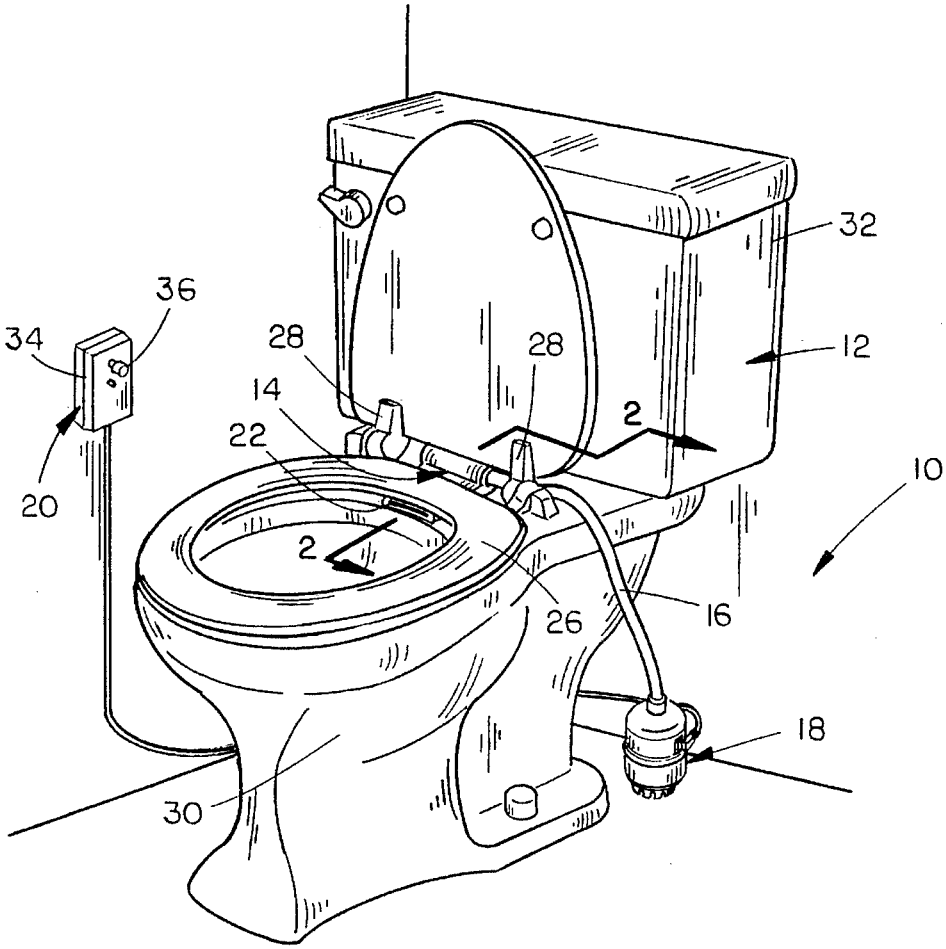
FIG. 1 is a perspective view of the portable ventilation system of the present invention installed on a conventional toilet.

Referring now to the drawings, in which similar or corresponding parts are identified with the same reference numeral, and more particularly to FIG. 1, the portable ventilation system of the present invention is identified generally at 10 and is shown installed on a conventional toilet 12. Ventilation system 10 includes an air duct 14 connected through an elongated tube 16 to a filter unit 18, which deodorizes air drawn therethrough and exhausts the fresh air to the room. A control unit 20 activates the filter unit as desired.

Figure 2:
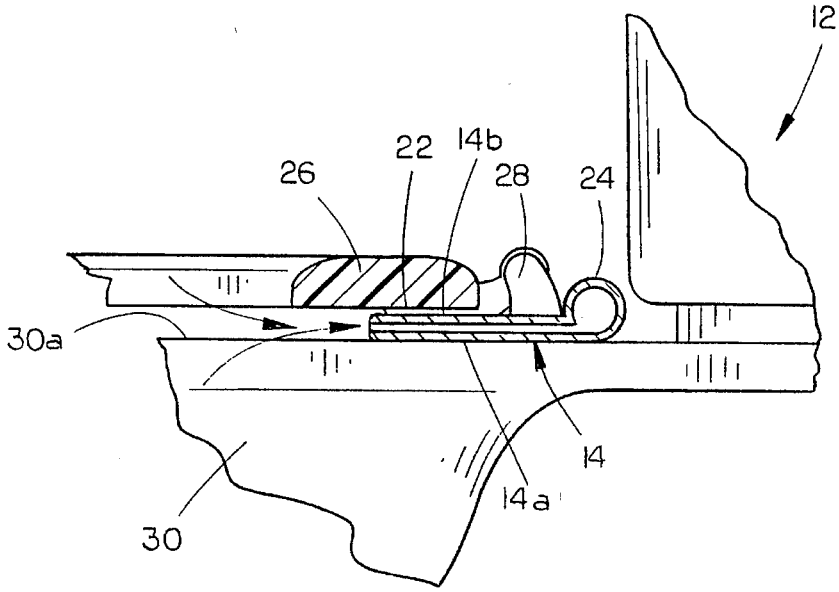
FIG. 2 is a sectional view taken at lines 2—2 in FIG. 1.
Figure 3:
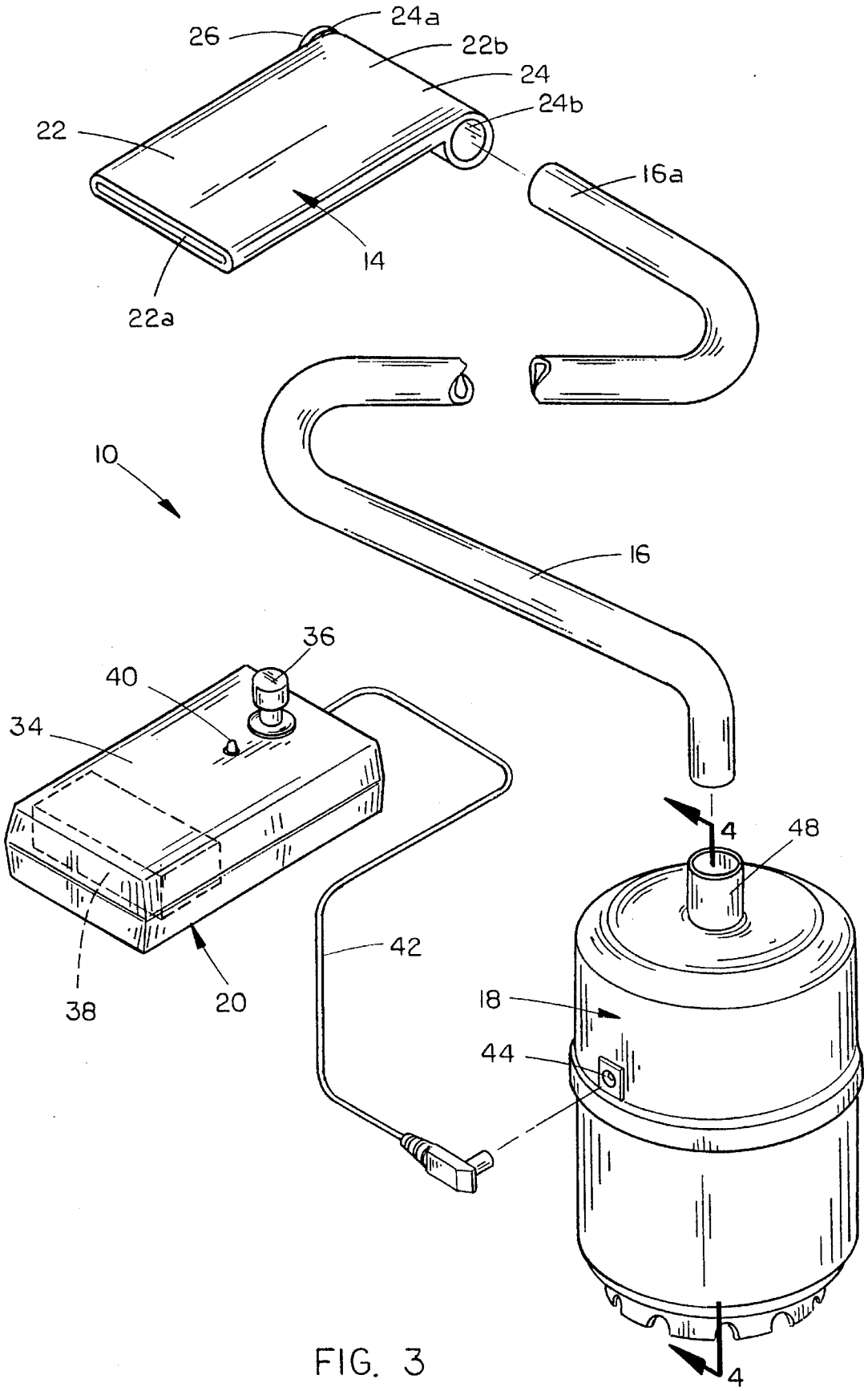
FIG. 3 is an enlarged exploded perspective view of the present invention.

Referring now to FIGS. 2 and 3, air duct 14 includes a flattened hollow intake portion 22 open at a forward end **22*a* and fluidly communicating with an adapter portion 24 at the rearward end 22*b* thereof. Adapter portion 24 is a generally hollow cylindrical tube extending transverse to the longitudinal axis of intake portion 22, and having opposing open first and second ends 24*a* and 24*b*. A plug 26 is removably mounted in end 24*a* of adapter portion 24 to fluidly seal that end. One end 16*a* of tube 16 is removably and fluidly connected to the open end 24*b* of adapter portion 24 to form a fluid passage from forward end 22*a* of intake portion 22 through adapter portion 24 and thence through tube 16**.

As shown in FIG. 2, a conventional toilet 12 includes a seat 26 connected to a support hinge 28 which operably supports the rearward portion of seat 26 spaced above the upper surface **30*a* of the toilet bowl 30. Air duct 14 includes a flat bottom surface 14*a* extending from forward end 22*a* of intake portion 22 to adapter portion 24. The thickness of intake portion 22, as measured between bottom surface 14*a* and top surface 14*b*, is less than the distance between the bottom of seat 26 and upper surface 30*a* of bowl 30 at hinge 28. In this way, intake portion 22 may be journaled under seat 26 between hinges 28 (as shown in FIG. 1) on top of bowl 30. As shown in FIG. 2, adapter portion 24 is located rearwardly of seat 26 and hinge 28 such that tube 16 will be located between seat 26 and the toilet tank 32, as shown in FIG. 1**.

Control unit 20 includes a housing 34 with a switch 36 operably mounted thereon. Switch 36 is operable to connect and disconnect a power source such as battery 38, shown in FIG. 3, to the filter unit 18. A light 40 in housing 34 is connected between switch 36 and power source 38 so as to illuminate when the electrical circuit to filter unit 18 is closed. A power cord 42 extends from control unit 20 and is removably connected to filter unit 18 at an electrical jack 44.

Figure 4:
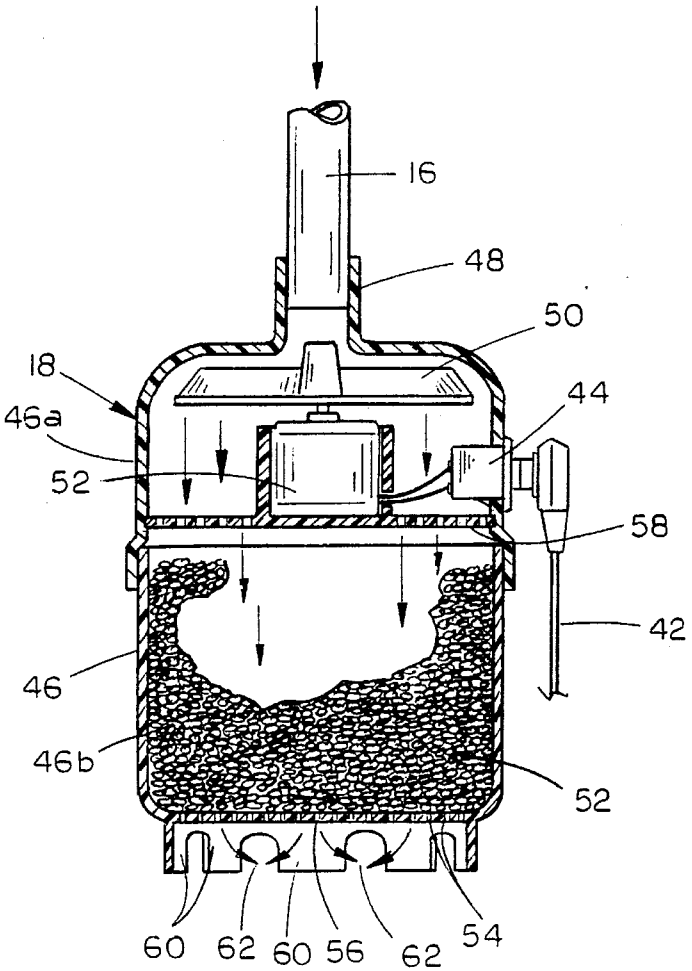
FIG. 4 is a sectional view taken at lines 4—4 in FIG. 3.

Referring now to FIG. 4, filter unit 18 includes a housing 46 having removably connected upper and lower halves **46*a* and 46*b*. Upper housing half 46*a* includes an intake port 48 connected to tube 16 to fluidly communicate with air duct 14, as shown in FIG. 3. An impeller 50 powered by a motor 52 forces air downwardly from housing upper half 46*a* to housing lower half 46*b*, thereby drawing air through intake port 48 from tube 16, as shown in FIG. 4. Motor 52 is electrically connected to jack 44 to receive power from power cord 42**.

Housing lower half **46*b* is filled with filter media 52, such as activated carbon, for filtering odors from air passing therethrough. A plurality of small apertures 54 are formed in the bottom 56 of housing lower half 46***b*, of a size to retain filter media 52 within housing 46, yet permit air to escape therefrom. In order to prevent filter media 52 from contacting the contents of housing upper half 46*a*, a perforated wall 58 is formed in upper half 46*a* with perforations of a size to prevent the passage of filter media 52.

A plurality of legs 60 support housing lower half 46*b* above the ground, with openings 62 between legs 60, to permit air to exhaust from apertures 65 in bottom 56.

Referring once again to FIG. 1, ventilation system 10 is operated by pushing switch 36 to close an electric circuit, thereby powering the impeller within filter unit 18. Operation of the impeller draws air through air duct 14, thence through tube 16 so as to pass through the filter media within filter unit 18. The filtered air then exits from the bottom of filter unit 18 and back into the room, to provide fresh deodorized air. Because filter unit housing 46 is separable between the upper and lower halves 46*a* and 46*b*, the charcoal filter media 52 may be replaced with fresh filter media as necessary. Each of the various components of ventilation system 10 is disconnectable, thereby permitting the easy transport of the ventilation system 10 to any desired bathroom.

Figure 5:
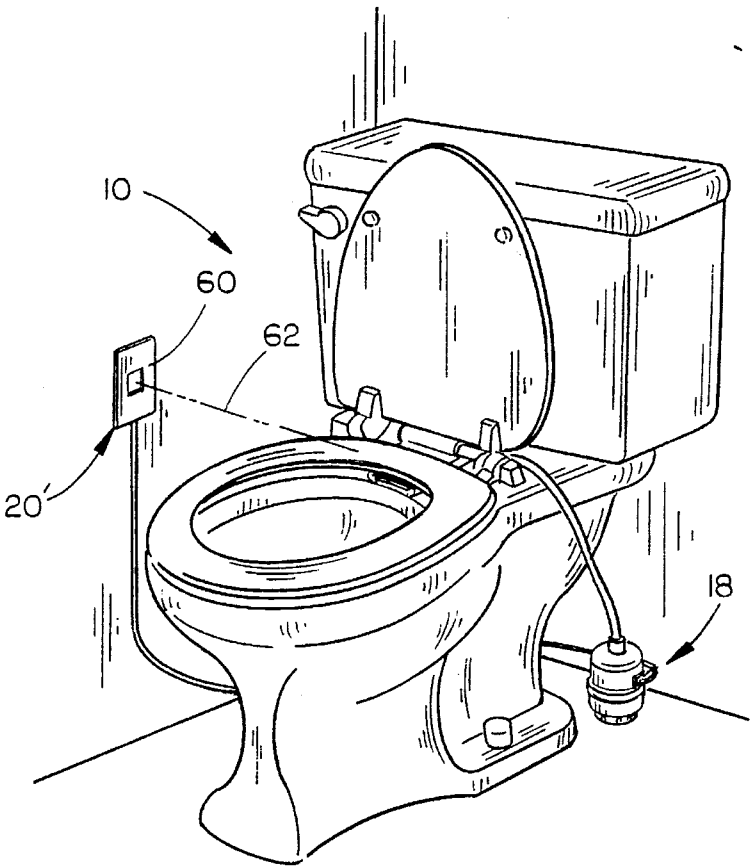
FIG. 5 is a perspective view of a second embodiment of the invention installed on a conventional toilet.

Referring now to FIG. 5, ventilation system 10 is shown with a second embodiment of a control unit, designated generally at 20'. Control unit 20' differs from the first embodiment of the control unit in the use of a sensor 60 to detect the presence of a person along an axis 62 projecting orthogonally from sensor 60 a predetermined distance. The presence of a person within a predetermined distance of sensor 60 will activate the control circuit to operate filter unit 18, as described hereinabove for the first embodiment.

Whereas the invention has been shown and described in connection with the preferred embodiments thereof, it should be understood that modifications, substitutions and addition may be made which are within the intended broad scope of the appended claims.

I claim:

1. A portable ventilation system, comprising:

an air filtration apparatus, including a hollow housing having an upper half removably connected to a lower half;

an intake port in an upper end of said upper half and a perforated wall across a lower end of the housing upper half;

a motor driven impeller operably mounted in the housing upper half between the intake port and the perforated wall, operable to draw air through the intake port and push air downwardly through the perforated wall;

said housing lower half being open at an upper end for removable connection to the lower end of the housing upper half, and having a plurality of exhaust apertures in a lower end thereof;

particulate filter media removably mounted within the housing lower half for filtering odors from air moving therethrough from the housing upper half to the exhaust apertures;

said exhaust apertures and perforated wall perforations being sized to prevent passage of the particulate media therethrough, but permitting the passage of air therethrough;

said housing lower half including a plurality of spaced apart legs depending therefrom to support the housing lower end above the ground, said exhaust apertures being formed in a bottom surface of the lower end of the housing lower half;

a power source electrically connected to the impeller motor to selectively operate the same;

a selectively operable control unit connected to said power source and said impeller motor to selectively provide power to the motor;

said control unit including an electrical circuit interconnecting a switch with the power source and the impeller motor, said switch operable between open and closed positions to selectively open and close the circuit;

an air duct located remotely from the air filtration apparatus, having an air intake at a forward end thereof; and a tube interconnecting the air duct and the intake port of the housing upper half.

2. The ventilation system of claim 1, wherein said power means is a battery.

3. The ventilation system of claim 1, wherein said air duct includes a flattened elongated tubular portion having forward and rearward longitudinal ends, and a generally cylindrical hollow adapter portion formed on the rearward end of the tubular portion and oriented transverse to the longitudinal axis of the tubular portion, said adapter portion fluidly communicating with the tubular member, and said ventilation system tube connected to said adapter portion for fluid communication through the adapter portion to the air intake of the air duct.

4. The ventilation system of claim 3, wherein said air duct includes a flat bottom surface extending from the tubular portion forward end to the adapter portion, wherein said tubular portion includes an upper surface parallel to the duct bottom surface, and wherein said adapter portion has a diameter which projects upwardly beyond the tubular member upper surface.

5. The ventilation system of claim 4, wherein said adapter portion includes opposing first and second open ends, the first end connected to said tube, and the second end selectively sealed with a removable plug.

6. The ventilation system of claim 1, wherein said housing upper half is slidably and telescopically connected to said housing lower half.

* * * * *